US012295483B1

(12) United States Patent
Parks

(10) Patent No.: US 12,295,483 B1
(45) Date of Patent: May 13, 2025

(54) HAMMOCK TREE STAND DEVICE AND ASSEMBLY

(71) Applicant: Timothy James Parks, Archdale, NC (US)

(72) Inventor: Timothy James Parks, Archdale, NC (US)

( * ) Notice: Subject to any disclaimer, the term of this patent is extended or adjusted under 35 U.S.C. 154(b) by 431 days.

(21) Appl. No.: 17/578,984

(22) Filed: Jan. 19, 2022

Related U.S. Application Data

(60) Provisional application No. 63/154,254, filed on Feb. 26, 2021.

(51) Int. Cl.
*A45F 3/26* (2006.01)
*A45F 3/00* (2006.01)

(52) U.S. Cl.
CPC ..... *A45F 3/26* (2013.01); *A45F 2003/001* (2013.01)

(58) Field of Classification Search
CPC ..... A45F 3/26
See application file for complete search history.

(56) References Cited

U.S. PATENT DOCUMENTS 4,474,265 A * 10/1984 Shinkle ..... A01M 31/02 297/452.17
4,589,522 A * 5/1986 Shelton ..... A01M 31/02 182/187
4,667,773 A * 5/1987 Davis ..... A01M 31/02 182/187
5,297,656 A * 3/1994 Amacker ..... A01M 31/02 182/187
7,370,728 B1 * 5/2008 Mann ..... A01M 31/02 182/187
8,770,348 B2 * 7/2014 Springs ..... A45F 3/26 182/187

* cited by examiner

*Primary Examiner* — Anthony D Barfield
(74) *Attorney, Agent, or Firm* — MacCord Mason PLLC

(57) ABSTRACT

A hammock tree stand device and assembly. In one embodiment, a suspended seat includes a base platform; a vertical support stanchion secured at one end of the base platform; a canted seat support secured at an opposing end of the platform; and an elongated flexible body removably secured to the canted seat support at one end and to the vertical post at the opposite end. The result is a hybrid lock-on suspended seat adapted to receive a weight of a user above a surface in a variety of configurations.

8 Claims, 4 Drawing Sheets

HAMMOCK TREE STAND DEVICE AND ASSEMBLY

This application claims priority to U.S. Provisional Application No. 63/154,254, filed Feb. 26, 2021, which is incorporated herein by reference in its entirety.

FIELD

The present disclosure relates generally to the field of hunting and, more particularly, to a universal hammock tree stand hunting system and assembly.

BACKGROUND

Tree stands are often open, semi-enclosed, or enclosed platforms, conventionally used by outdoorsmen, or the like, during elevated activities, including, but not limited to hunting. Traditionally, these platforms are secured to trees, or vertical supports, to elevate the user for visual optics, stealth, and/or improved vantage points. One conventional approach is a ladder stand, which may include a stand with a seat/platform combination, for instance along the ladder to climb into the stand. Often, the ladder stand has a connection to the tree or the like. Hanging stands are another option to provide the user a vantage point, where in the hanging stand is similar to the ladder stand, but without the ladder access. Box stands are another type of structure built at various heights and with any combination of elements, applications. However, all these known stands fail to provide the user with the combination of convenience, comfort, and efficiency.

Therefore, Applicant desires systems and methods of hammock tree stands without the drawbacks presented by traditional systems and methods.

BRIEF DESCRIPTION OF THE DRAWINGS

Embodiments of the disclosure will be better understood by a reading of the Description of Embodiments along with a review of the drawings, in which.

SUMMARY

Figure 1:
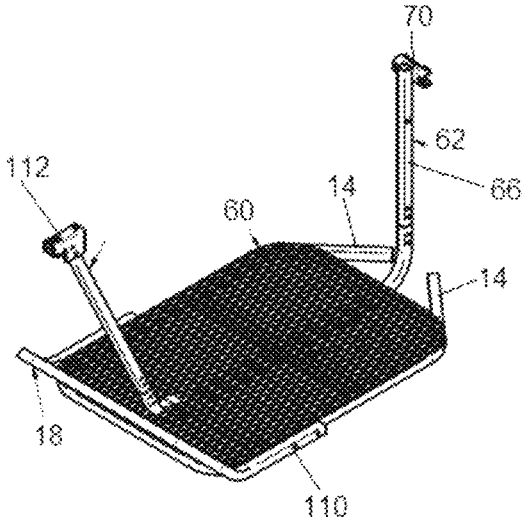
FIG. 1 is a top perspective view of a universal hammock tree stand according to one embodiment of the disclosure, with elements removed for clarity.
Figure 2:
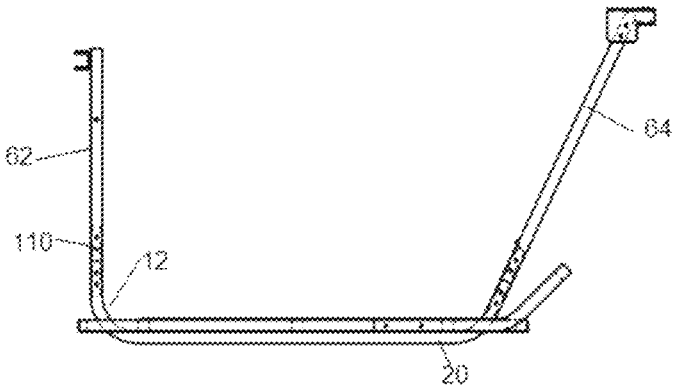
FIG. 2 is a side view of a universal hammock tree stand according of FIG. 1.

Applicant desires a hammock tree stand device, system, assembly, and method of use without the drawbacks presented by the traditional systems and methods. Those skilled in the art having the benefit of this disclosure will recognize additional features, advantages over conventional systems, and improvements for the enjoyment of tree stands.

In accordance with the present inventions, a tree stand device and assembly is provided for receiving and supporting a user above a surface. These inventions provide an improved hybrid device and system that is convenient, efficient, and safe for the user, particularly when used in suspending a user about a vertical post, for instance during hunting or other outdoor activities.

In one embodiment, a suspended seat platform comprises a base platform having at least one crossbar, a plurality of alignment holes, and a substantially rigid upper base surface adapted to receive a weight of a user; a vertical support stanchion secured at one end of the base platform and having an engagement footing with an outer teeth surface adapted to engage the vertical post, a first tether adapted to tether about the vertical post, an elongated length adapted to align with the vertical post at multiple contact points; and a canted seat support secured at an opposing end of the base platform, and typically, a user's feet cannot touch a ground surface in the elevated operating position.

In one embodiment, a suspended seat comprises a base platform; a vertical support stanchion secured at one end of the base platform; a canted seat support secured at an opposing end of the base platform; and an elongated flexible, suspendable hammock chair body adapted to receive a weight of a user and removably secured to the canted seat support at one end and to a vertical post at an opposite end.

In certain examples, the seat may include a lock-on open platform. The lock-on open platform may include a first lateral extension member offset from a second lateral extension member about a vertical support stanchion. The elongated flexible body may include an upper end removably secured about the vertical post. The upper end may be secured at high height with respect to the base platform to provide an upright orientation adapted for an archery alignment. The upper end may be secured at low height with respect to the base platform to provide a reclined orientation adapted for a rifle hunting alignment. The elongated flexible body may include a concave surface spaced between the pair of opposing tapered portions, and wherein the concave surface having a width adapted to support a user in a substantially suspended position. The elongated flexible body may provide a secondary anchor support wherein a user straddles the elongated flexible body in a substantially upright position. The substantially upright position may include a standing position. The elongated flexible body may include a woven unfixed seat with respect to the base platform.

In one embodiment, a seat assembly comprises a lock-on open platform having a proximate portion adapted to be secured about a vertical post and an opposing cantilevered distal portion; and an elongated flexible body adapted to receive a weight of a user and removably aligned above the lock-on open platform.

In certain examples, the platform may include at least one crossbar. The platform may include a substantially perpendicular reinforcing member. The platform may include a substantially rigid upper base surface adapted to receive a weight of a user. The proximate portion may include a vertical support stanchion having an engagement footing. The vertical support stanchion may include a first tether adapted to tether about the vertical post. The proximate portion may include a first lateral extension member adapted to extend beyond a support platform; and second lateral extension member adapted to extend beyond a support platform. The distal portion may include a canted seat support. The distal portion may include a rest bar.

In one embodiment, a suspended seat comprises a base platform; a vertical support stanchion secured at one end of the base platform; a canted seat support secured at an opposing end of the base platform; and an elongated flexible body adapted to receive a weight of a user and removably secured to the canted seat support at one end and to a vertical post at an opposite end.

In particular examples, the elongated flexible body includes an upper end removably secured about the vertical post. The upper end is removably secured about a plurality of multipositionable heights about the vertical post. The upper end may include a third tether adapted to tether about the vertical post. The assembly may include a fastener adapted to secure the third tether. The upper end may be secured at high height with respect to the base platform to provide an upright orientation adapted for an archery alignment. The upper end may be secured at low height with respect to the base platform to provide a reclined orientation adapted for a rifle hunting alignment.

In certain examples, the elongated flexible body includes a pair of opposing tapered portions. The elongated flexible body may include a concave surface spaced between the pair of opposing tapered portions. The elongated flexible body may include a concave surface having a width adapted to support a user in a substantially suspended position. The elongated flexible body may be removable. The elongated flexible body may be a suspendable hammock chair. The elongated flexible body may provide a secondary anchor support wherein a user straddles the elongated flexible body in a substantially upright position. The substantially upright position may include a standing position. The flexible body may include a woven unfixed seat with respect to the base platform.

In one embodiment, a seat assembly comprises a lock-on open platform having a proximate portion adapted to be secured about a vertical post and an opposing cantilevered distal portion; and an elongated flexible body adapted to receive a weight of a user and removably aligned above the lock-on open platform.

In particular examples, the platform comprises at least one crossbar. The platform may include a substantially perpendicular reinforcing member. The platform may include a plurality of alignment holes. The assembly may include a plurality of fasteners. The platform may include a substantially rigid upper base surface adapted to receive a weight of a user. The substantially rigid upper surface may include at least one drainage vent. The proximate portion may include a vertical support stanchion. The distal end of the vertical support stanchion may include an engagement footing. The engagement footing may include an outer surface adapted to engage the vertical post. The outer surface may include a teeth engaging configuration. The vertical support stanchion having a first tether may tether about the vertical post. The first tether may be secured about a distal end of the vertical post. The assembly may include a fastener adapted to secure the first tether.

In particular examples, the vertical support stanchion may include an elongated length adapted to align with the vertical post. The elongated length may contact the vertical post at multiple points. The proximate portion may include a first lateral extension member. The first lateral extension member may extend beyond a support platform. The proximate portion may include a second lateral extension member. The second lateral extension member may extend beyond a support platform.

In certain examples, the proximate portion comprises a first lateral extension member offset from a second lateral extension member about a vertical support stanchion. The first lateral extension member and the second lateral extension member may include adjacent proximate ends secured at the vertical stanchion. The distal portion may include a canted seat support. The canted seat support may align at an obtuse angle about an opposing vertical support stanchion. The canted seat support may slant less than perpendicular from a base surface.

In particular examples, the canted seat support includes a seat bracket. The canted seat support may protrude through a platform base. The distal portion may include a rest bar. The rest bar may include an extension member secured about a platform base. The extension member may align outside of a platform base. The rest bar may include a right receiving surface and a left receiving surface adapted to support a user's respective feet. The elongated flexible body may vertically offset the right receiving surface and the left receiving surface. The lock-on open platform may include a second tether adapted to tether about the vertical post. The second tether may be secured about a proximate end of a support platform. The second tether may be secured at two points of the support platform. The second tether may be secured to one edge of the support platform and secured to another edge of the support platform. The two points may be spaced apart from one another. The assembly may include a fastener adapted to secure the second tether.

In certain examples, the proximate portion and opposing cantilevered distal portion being co-planar and substantially may be perpendicular to the vertical post in an operating position. The elongated flexible body may include an upper end removably secured about the vertical post. The upper end may be removably secured about a plurality of multipositionable heights about the vertical post. The upper end may include a third tether adapted to tether about the vertical post. The assembly may include a fastener adapted to secure the third tether. The upper end may be secured at high height with respect to a base platform to provide an upright orientation adapted for an archery alignment. The upper end may be secured at low height with respect to a base platform to provide a reclined orientation adapted for a rifle hunting alignment.

In particular examples, the elongated flexible body includes a pair of opposing tapered portions. The elongated flexible body may include a concave surface spaced between the pair of opposing tapered portions. The elongated flexible body may include a concave surface having a width adapted to support a user in a substantially suspended position. The elongated flexible body may be include removable. The elongated flexible body may be a suspendable hammock chair. The elongated flexible body may provide a secondary anchor support wherein a user straddles the elongated flexible body in a substantially upright position. The substantially upright position may include a standing position on a platform support.

In certain examples, the elongated flexible body is a woven unfixed seat with respect to the lock-on open platform. The elongated flexible body may be offset from the lock-on open platform. The elongated flexible body may be vertically spaced from the lock-on open platform. The elongated flexible body may be aligned independent of the alignment of the lock-on open platform. The elongated flexible body may include a hammock chair assembly. The assembly may include at least one tree engaging member. The proximate portion may be restable about the vertical post and removably affixed with at least one tether. The seat assembly may align in an elevated operating position. In certain examples, the user cannot touch a ground surface with feet in the elevated operating position. The seat assembly may include a substantially rigid material. The vertical post may include a tree, a telephone pole, a power pole, a combination thereof, and the like. The lock-on platform and the elongated flexible body may be an integral assembly. A ladder may extend substantially adjacent the platform.

In one embodiment, a suspended seat platform comprises a base platform; a vertical support stanchion secured at one end of the base platform; and a canted seat support secured at an opposing end of the base platform.

In certain examples, the platform comprising at least one crossbar. The platform may include a plurality of alignment holes. The assembly may include a plurality of fasteners. The platform may include a substantially rigid upper base surface adapted to receive a weight of a user. The substantially rigid upper surface may include at least one drainage vent. The distal end of the vertical support stanchion may include an engagement footing. The engagement footing may include an outer surface adapted to engage the vertical post. The outer surface may include a teeth engaging configuration.

In particular examples, the vertical support stanchion has a first tether adapted to tether about a vertical post. The first tether may be secured about a distal end of the vertical post. The assembly may include a fastener adapted to secure the first tether. The vertical support stanchion may include an elongated length adapted to align with a vertical post. The elongated length may contact the vertical post at multiple points. The assembly may include a first lateral extension member. The first lateral extension member may extend beyond the base platform. The platform may include a second lateral extension member. The second lateral extension member may extend beyond the base platform. The platform may include a first lateral extension member offset from a second lateral extension member about the vertical support stanchion. The first lateral extension member and the second lateral extension member may include adjacent proximate ends secured at the vertical stanchion.

In certain examples, the canted seat support is aligned at an obtuse angle about the vertical support stanchion. The canted seat support may be slanted less than perpendicular from the base platform. The canted seat support may include a seat bracket. The canted seat support may protrude through the base platform. The platform may include a rest bar. The rest bar may include an extension member secured about the base platform. The extension member may align outside of the base platform. The rest bar may include a right receiving surface and a left receiving surface adapted to support a user's respective feet. The elongated flexible body may vertically offsets the right receiving surface and the left receiving surface. The platform may include a second tether adapted to tether about a vertical post. The second tether may secured about a proximate end of the base platform. The second tether may be secured at two points of the base platform. The second tether may be secured to one edge of the base platform and secured to another edge of the base platform. The two points may be spaced apart from one another. The platform may include a fastener adapted to secure the second tether.

In one embedment, in suspended seat assembly having a vertical support stanchion and a canted seat support, an elongated flexible body adapted to receive a weight of a user and removably secured to the canted seat support at one end and to a vertical post at an opposite end.

The above summary was intended to summarize certain embodiments of the present disclosure. Embodiments will be set forth in more detail in the FIGS. and description of embodiments below. It will be apparent, however, that the description of embodiments is not intended to limit the present inventions, the scope of which should be properly determined by the appended claims.

DETAILED DESCRIPTION

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing embodiments of the disclosure and are not intended to limit the disclosure or any inventions thereto. As best seen in FIGS. 1-4, the universal seat assembly 10 provides suspending operating positions about a vertical post. As shown in the figures, the seat assembly may include a lock-on open platform 60, a vertical support stanchion 62, a canted seat support 64, and an elongated flexible body 80, for instance any of the hammock, or similar, examples shown and described herein. Those skilled in the art having the benefit of this disclosure will recognize additional sizes, orientations, material, and arrangement of elements.

Figure 3:
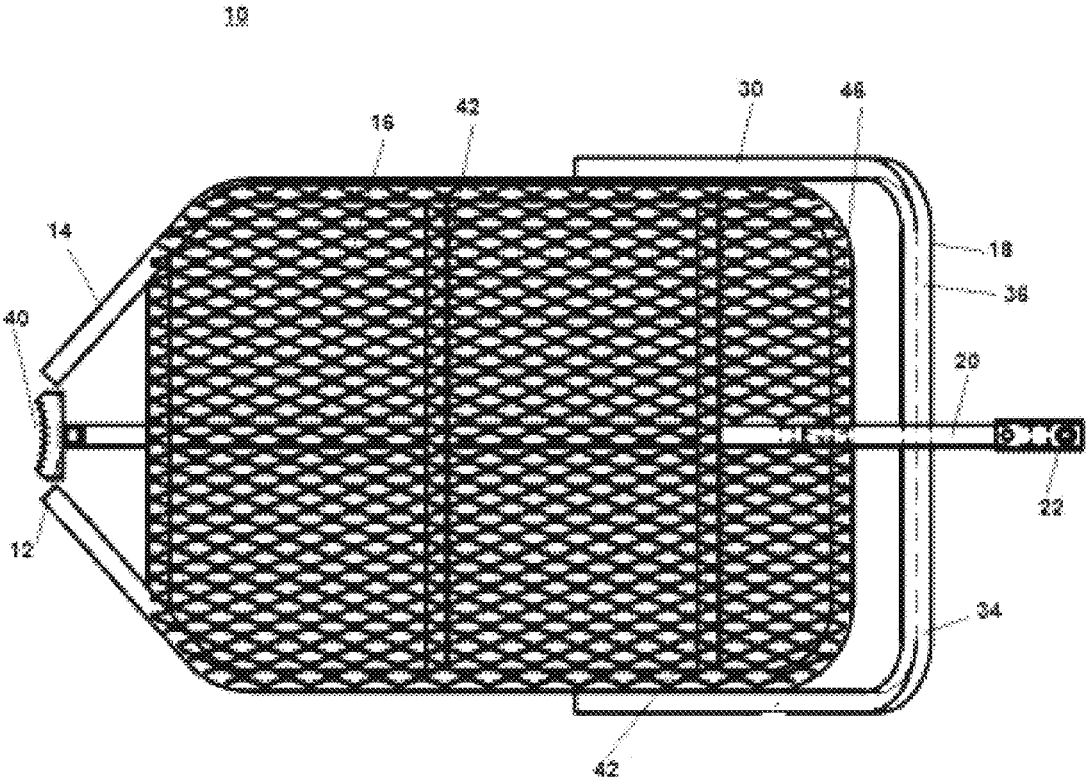
FIG. 3 is a top view of a universal hammock tree stand according of FIG. 1.
Figure 4:
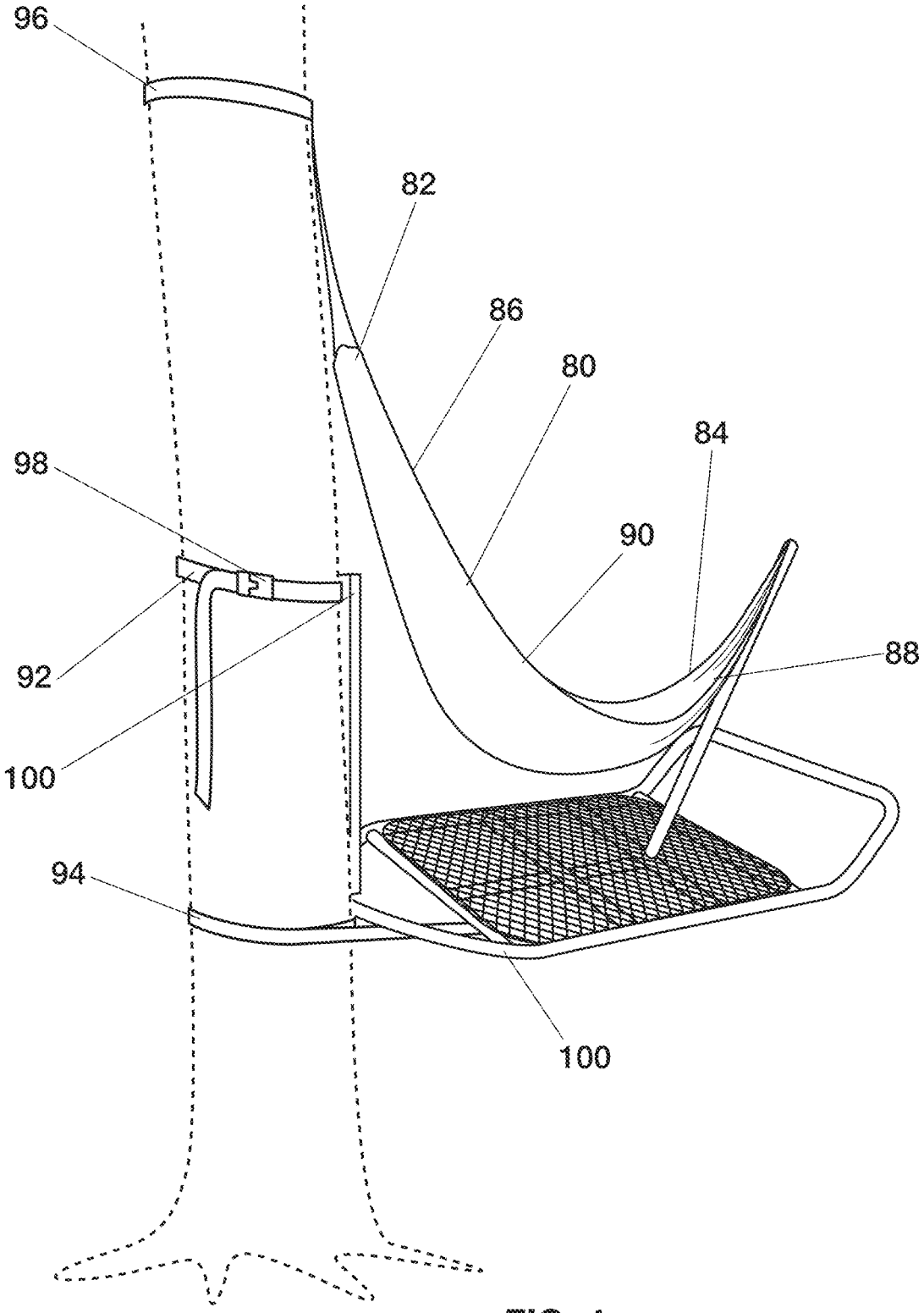
FIG. 4 is a side perspective view of a universal hammock tree stand assembly according to one embodiment of the disclosure in an operating position.

As shown in FIG. 1-4, one embodiment of seat assembly 10 includes a lock-on type open platform 60 having a proximate portion secured about a vertical post, and an opposing cantilevered distal portion. As shown in FIG. 4, the elongated flexible body 80 may receive a weight of a user and be removably aligned above the lock-on open platform.

As shown in FIGS. 1-4, the platform 60 may have at least one crossbar 42. The platform 60 may include a substantially perpendicular reinforcing member 20. The platform 60 may include a plurality of alignment holes 110. The distal end of the vertical support stanchion 62 may include an engagement footing 70. As shown in FIG. 4, the vertical support stanchion 62 may have a first tether 92, for instance to tether about the vertical post.

In particular examples, the vertical support stanchion may include an elongated length 66 to align with the vertical post. The proximate portion may include a first lateral extension member 14. As shown, the first lateral extension member 14 may extend beyond support platform 60 to provide any of the stability and weight-bearing support shown and described herein. The proximate portion may include a second lateral extension member 14. Similarly, the second lateral extension member 14 may extend beyond support platform 60 to provide any of the stability and weight-bearing support shown and described herein.

As shown in FIG. 1, the canted seat support 64 may have a seat bracket 112. The device may include a rest bar 18. As shown in FIG. 3, the rest bar 18 may include an extension member 30 secured, for instance welded or fastened as any of the elements shown and described herein, about platform base 60. The rest bar 18 may include a right receiving surface 36 and a left receiving surface 34, for instance to support a user's respective feet.

As shown in FIG. 4, the platform may include a second tether 94 adapted to tether about the vertical post. The assembly may include a fastener 100 adapted to secure the second tether 94 in any of the operating positions shown and described herein. Further, the upper end 82 the elongated hammock seat 80 may include a third tether 96 adapted to tether about the vertical post.

As shown in FIG. 4, the elongated flexible body 80 may include a pair of opposing tapered portions 86, 88. The elongated flexible body 80 may include a concave surface 90.

In one embodiment, a suspended seat comprises a base platform 60; a vertical support stanchion 62 secured at one end of the base platform 60; a canted seat support 64 secured at an opposing end of the base platform 60; and an elongated flexible body seat 80 to receive a weight of a user and removably secured to the canted seat support 64 at one end and to a vertical post at an opposite end for use during hunting or other outdoor activities.

Those skilled in the art having the benefit of this disclosure will recognize additional scaling, elemental orientation, and arrangements within the spirit of this disclosure.

In other embodiments, the disclosure includes a universal seat assembly kit. In such an embodiment, the kit may comprise a platform 60, e.g. any of the platform elements and components previously shown or described. Further, other embodiments of the kit may an elongated hammock seat 80, e.g. any combination of seats and the like elements and components previously shown or described.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

What is claimed is:

1. A suspended seat system comprising:

a. a base platform;

b. a vertical support stanchion secured at one end of said base platform;

c. a canted seat support secured at an opposing end of said base platform; and d. an elongated flexible, suspendable hammock chair body removably secured to said canted seat support at one end and to a vertical post at an opposite end, and wherein said elongated flexible body includes a concave surface spaced between said pair of opposing tapered portions, and wherein said concave surface having a width adapted to support a user in a substantially suspended position and wherein said elongated flexible body is a woven unfixed seat with respect to said base platform, and wherein said base platform having a proximate portion adapted to be secured about a vertical post and an opposing cantilevered distal portion, and wherein said elongated flexible, suspendable hammock chair body offsets said proximate portion and said opposing cantilevered distal portion.

2. The suspended seat system of claim 1, wherein said base platform being a lock-on open platform.

3. The suspended seat system of claim 2, wherein said lock-on open platform comprises a first lateral extension member offset from a second lateral extension member about a vertical support stanchion secured at one end of the base platform.

4. The suspended seat system of claim 1, wherein said elongated flexible body includes an upper end removably secured about said vertical post.

5. The suspended seat system of claim 4, wherein said upper end secured at high height with respect to said base platform to provide an upright orientation adapted for an archery alignment.

6. The suspended seat system of claim 4, wherein said upper end secured at low height with respect to said base platform to provide a reclined orientation adapted for a rifle hunting alignment.

7. The suspended seat system of claim 1, wherein said elongated flexible body adapted to provide a secondary anchor support wherein a user straddles said elongated flexible body in a substantially upright position.

8. The suspended seat system of claim 7, wherein said substantially upright position comprises a standing position.

* * * * *